US008269151B2

(12) United States Patent
Klasmeier et al.

(10) Patent No.: US 8,269,151 B2
(45) Date of Patent: Sep. 18, 2012

(54) METHOD FOR DISPLAYING, PARTICULARLY A HEATING OR COOLING CURVE, AND COOKING APPLIANCE FOR CARRYING OUT SUCH A METHOD

(75) Inventors: Juergen Klasmeier, Landsberg/Lech (DE); Michael Greiner, Landsberg/Lech (DE); Peter Wiedemann, Klosterlechfeld (DE); Manfred Breunig, Schongau (DE); Bruno Maas, Wertach (DE); Michael Fink, Wessling (DE); Judith Kling, Landsberg/Lech (DE); Cornelia Dietmayer, Weil (DE)

(73) Assignee: Rational AG, Landsberg/Lech (DE)

( * ) Notice: Subject to any disclaimer, the term of this patent is extended or adjusted under 35 U.S.C. 154(b) by 568 days.

(21) Appl. No.: 12/518,275

(22) PCT Filed: Dec. 6, 2007

(86) PCT No.: PCT/DE2007/002210

§ 371 (c)(1),
(2), (4) Date: Dec. 30, 2009

(87) PCT Pub. No.: WO2008/067805

PCT Pub. Date: Jun. 12, 2008

(65) Prior Publication Data

US 2010/0213182 A1 Aug. 26, 2010

(30) Foreign Application Priority Data

Dec. 8, 2006 (DE) ..... 10 2006 057 923

(51) Int. Cl.
*H05B 1/00* (2006.01)

(52) U.S. Cl. ..... 219/490; 219/201; 219/391; 219/492

(58) Field of Classification Search ..... 219/201, 219/391, 490, 492

See application file for complete search history.

(56) References Cited

U.S. PATENT DOCUMENTS 4,484,065 A * 11/1984 Ueda ..... 219/492

(Continued)

FOREIGN PATENT DOCUMENTS

DE 32 12 250 A1 10/1983

(Continued)

OTHER PUBLICATIONS

International Search Report mailed Jun. 6, 2008, in corresponding Application No. PCT/DE2007/002210, filed Dec. 6, 2007, 3 pages.

*Primary Examiner* — Matthew W Such
*Assistant Examiner* — David Spalla
(74) *Attorney, Agent, or Firm* — Christensen O'Connor Johnson Kindness PLLC

(57) ABSTRACT

The invention relates to a method for displaying the curve when a desired climate has been reached in a cooking compartment of a cooking appliance by taking into account at least one actual value of the first variable that changes over time and is characteristic of the climate in the cooking compartment. Said method is characterized in that the actual value of the first variable is detected at least once during an interval $t_0$ to $t_1$ and is compared with a desired value of the first variable, said desired value characterizing the desired climate, a point in time $t_2$ when a second interval is to begin and/or the point in time $t_3$ when the desired climate has been reached is/are estimated in accordance with said comparison, and the course of the first variable over time is taken into account at least once when estimating the point in time $t_3$ during a second interval $t_2$ to $t_3$, wherein $t_2 \geqq t_1$. The invention also relates to a cooking appliance for carrying out such a method.

42 Claims, 2 Drawing Sheets

U.S. PATENT DOCUMENTS

| | | | | |
|---|---|---|---|---|
| 4,517,431 | A | 5/1985 | Ueda | |
| 4,803,344 | A | 2/1989 | Wolf | |
| 5,780,823 | A | 7/1998 | Uehashi | |
| 6,299,921 | B1 * | 10/2001 | Loffler et al. | 426/233 |
| 7,409,311 | B2 | 8/2008 | Imgram | |

FOREIGN PATENT DOCUMENTS

| | | | |
|---|---|---|---|
| DE | 36 42 181 | C1 | 4/1988 |
| DE | 195 41 608 | A1 | 5/1997 |
| DE | 195 33 514 | A1 | 9/1997 |
| DE | 196 09 116 | A1 | 9/1997 |
| DE | 197 07 797 | A1 | 10/1997 |
| EP | 0 762 060 | A1 | 3/1997 |
| EP | 1 022 972 | B1 | 7/2002 |
| JP | 57-187533 | A | 11/1982 |
| JP | 58-117927 | A | 7/1983 |
| JP | 01-112684 | A | 5/1989 |
| WO | 2006/045290 | A1 | 5/2006 |

* cited by examiner

METHOD FOR DISPLAYING, PARTICULARLY A HEATING OR COOLING CURVE, AND COOKING APPLIANCE FOR CARRYING OUT SUCH A METHOD

The present invention relates to a method for displaying the progress when reaching a desired climate in a cooking chamber of a cooking appliance taking into consideration at least one actual value of at least one first variable, which is characteristic for the climate in the cooking chamber and changes over time, and a cooking appliance for performing such a method.

A generic method is known, for example, from JP 57-187533, whereas the desired climate being determined therein by a desired cooking chamber temperature, and the cooking chamber temperature and the voltage at a power source of a heating unit being used as the first variable for calculating the time still required to reach the desired cooking chamber temperature, i.e., remaining heating time. The remaining heating time thus calculated is then digitally displayed on a heating progress display, during a preheating step. As soon as the desired cooking chamber temperature is reached and the preheating step is thus concluded, a signal is output in order to indicate to the user that the cooking chamber of the cooking appliance is now chargeable with cooking product.

The known method has fundamentally proven itself, but because of its solely punctual calculation, viewed chronologically, of the remaining heating time in a preheating step, it has imprecision in the cited display.

Furthermore, a corresponding punctual calculation of a heating progress in a preheating step is described in JP 11-12684 and JP 11-7927. EP 0 762 060 A1 discloses the calculation of a remaining heating time in a heating step to reach a desired cooking chamber temperature with use of stored tables, a detected power supply and maintenance, and taking into consideration a slope of at least two temperature measurements, without details having been disclosed in this regard, however.

A regulating circuit for a baking oven having a desired temperature center and a display unit for displaying a preheating progress is known from DE 195 41 608 A1. The regulating circuit calculates the duration to be expected until reaching the desired temperature from a particular actual temperature and the particular set desired temperature as well as a stored, time-related temperature increase and conducts a corresponding signal to the display unit, so that during the preheating procedure, the display unit displays either after which period of time or at what time of day the desired temperature is to be reached.

DE 195 33 514 A1 discloses a method for regulating the heating power during the preparation of foods, in which, by measuring a temperature-time progress during a heating procedure, a following food heating process is to be performed specifically to a predetermined temperature and is to be maintained for a predetermined period of time.

DE 197 07 797 A1 discloses a microwave oven for warming up a food using a heating device taking a first parameter into consideration, which represents a degree of the rise of the temperature in a predetermined period of time in an initial phase of heating of the food, and a second parameter, which represents a degree of the rise of the temperature after passage of the predetermined period of time.

DE 196 09 116 A1 describes cooking as a function of a detected core temperature, the core temperature being sampled multiple times in sequence at a defined point in time in a test step and a final point in time being ascertained from the sampled values, at which a desired core temperature is to be reached.

The influence of a starting temperature in the evaluation of a heating curve is disclosed in DE 36 42 181 C1.

In particular, it is known from EP 1 022 972 B1 that a cooking process which is a function of at least one measured value of a cooking status variable may be guided particularly precisely if the direction occurs as a function of one or more values of a derivative of the cooking status variable according to time.

In addition, performing a heat supply regulation as a function of measured values detected via two temperature sensors situated at different points in a cooking chamber is known from DE 32 12 250 A1, a first sensor being able to measure an ambient air temperature in the cooking chamber and a second sensor being able to measure a surface temperature of a food to be heated.

The object of the present invention is to refine the generic method in such a way that it provides the most precise possible display of a progress upon reaching a desired climate.

This object is achieved according to the invention in that, in a first time interval from $t_0$ to $t_1$, the actual value of the first variable is detected at least once and compared to a desired value of the first variable which characterizes the desired climate and, as a function of this comparison, a moment $t_2$, at which a second time interval is to start, and/or the moment $t_3$ of reaching the desired climate is/are estimated, and in a second time interval from $t_2$ to $t_3$, with $t_2 \geqq t_1$, the progress of the first variable over time is taken into consideration at least once in the estimation of the moment $t_3$.

It may be provided that upon the estimation of $t_3$, in particular in the first time interval, a linear relation is assumed between the first variable and the time, and/or upon the estimation of $t_3$, in particular in the second time interval, use is made of stored tables for the chronological development of the first variable.

It is also proposed by the invention that the course of the first variable over time is determined via at least one time derivative, in particular the first and/or second time derivative, of the first variable, preferably, $t_2=t_1$.

Alternatively, it may also be provided that the course of the first variable over time is evaluated in a heating pause of $t_1$ to $t_2$ with $t_2>t_1$.

It is proposed according to the invention that the difference of the first variable at the moment $t_2$ and the first variable at the moment $t_1$ is analyzed.

Furthermore, it may be provided that the first variable is determined by at least one temperature, one moisture, and/or one flow rate.

It is also proposed that the first variable is detected in the cooking chamber, preferably in the form of the cooking chamber temperature GT and/or on a wall of the cooking chamber, preferably in the form of the wall temperature, and/or in a steam generator of the cooking appliance, in particular in the form of the water temperature in the steam generator.

It is preferable that at least the cooking chamber temperature is detected, preferably the cooking chamber temperature and the wall temperature, in particular in a preheating or precooling step before charging of the cooking chamber with cooking product to be cooked.

Furthermore, it is proposed according to the invention that a first first variable is detected in the form of the cooking chamber temperature in the first time interval, and a second first variable is detected in the form of the wall temperature in the second time interval, preferably $t_2=t_1$.

A zeroth time interval with $t \leqq t_0$ may also be provided, within which the moment $t_3$ is estimated at least once as a function of a third first variable in the form of the temperature of the steam generator.

In addition, it is proposed that in a preheating step at the moment $t_0$, the temperature of the steam generator reaches a first desired value, in particular in a range from 80° C. to 90° C., preferably approximately 85° C., and at the moment $t_1$, the cooking chamber temperature reaches a second desired value, preferably the desired preheating temperature, and at the moment $t_3$, the wall temperature reaches a third desired value, which preferably corresponds to the second desired value, and at the moment $t_3$, the wall temperature reaches a third desired value, which preferably corresponds to the second desired value.

Furthermore, preferred methods according to the invention are characterized in that at least one second variable characteristic for the climate in the cooking chamber is taken into consideration at least once upon the estimation of the moment $t_3$, the second variable preferably not changing from $t_0$ to $t_3$, in normal operation of the cooking appliance.

It may be provided that the second variable is determined by the history of the operation of the cooking appliance, in particular in the form of the operating time and/or at least one setting of the cooking appliance at the moment $t_0$ and/or before the moment $t_0$.

Furthermore, it is proposed by the invention that the setting is selected from the setting of a heating unit, a cooling unit, a cooking chamber atmosphere circulation unit, a unit for introducing moisture into the cooking chamber, a unit for exhausting moisture from the cooking chamber, a unit for atomizing water in the cooking chamber, a power storage unit, an operating unit, and/or a unit for cleaning the cooking chamber.

Furthermore, it may be provided that the setting is determined by a first use of the cooking appliance which has occurred before the moment $t_0$.

It is also proposed by the invention that the second variable is determined by the climate and/or the geodetic height at the setup location of the cooking appliance.

Furthermore, it may be provided that the second variable is determined by an opening of the cooking chamber, in particular the duration, the frequency, and/or the size of the cooking chamber opening.

It is preferable that the second variable is determined by a malfunction of the cooking appliance, for example, in the form of a power failure, a defective actuator, a water failure, or the like.

It is also proposed by the invention that the desired climate is manually input via an operating unit of the cooking appliance or is automatically selected after selection of a second use of the cooking appliance and the initiation thereof at the moment $t_0$.

Furthermore, it may be provided that the first and/or second use are selected from a cooking method, a cleaning method, and/or a decalcification method.

It may also be provided that a heating progress is displayed, in particular in a preheating step, or a cooling progress is displayed, in particular in a precooling step.

It is preferable according to the invention that the display of the progress, in particular the estimation of the moment $t_3$, is updated in regular time steps, a step preferably taking 0.3 to 3 seconds.

Furthermore, it is proposed that the difference between the particular estimated moment $t_3$ and the particular time which has passed since the beginning of the method is displayed, preferably on a display unit, at a plurality of moments t.

It may be provided that the display unit has a display area for each time interval, the progress preferably being shown in each display area in the form of a growing bar, in particular by a color change and/or by a lighting change.

It is proposed according to the invention that three display areas, preferably each in rectangular form, are situated adjacent to one another, firstly a zeroth display area being provided for the zeroth time interval, then a first display area being provided for the first time interval, and finally a third display area being provided for the third time interval.

Embodiments of the invention may also be characterized in that, at a moment $t_4$ with $t_3 \leqq t_4$, a signal, in particular in the form of a charge request in the case of a use in the form of a cooking method, is output, preferably visually and/or acoustically.

Furthermore, it is proposed by the invention that the progress, in particular the heating progress or cooling progress, is taken into consideration in a second use of the cooking appliance, at least from a moment $t_5$, with $t_5 \geqq t_3$, in particular $t_3 \leqq t_4 \leqq t_5$, preferably during the direction of a cooking method.

Furthermore, it is proposed by the invention that in a third time interval from $t_3$ to $t_4$, with $t_4 \geqq t_3$, the course of the first variable is detected over time and taken into consideration during the direction of a cooking method from the moment $t_5$, with $t_5 \geqq t_4$.

Furthermore, it may be provided that the moment $t_5$ is determined by the progress. It may be provided that in the third time interval, a transient oscillation of the first variable to its desired value is evaluated, in particular by detecting the frequency and/or the amplitude of the corresponding oscillation.

According to the invention, a cooking appliance having a cooking chamber, a heating unit, a timer, for example, in the form of a clock, at least one measuring unit for detecting the first variable, for example, in the form of a cooking chamber temperature GT, a display unit, and a control or regulating unit for performing a method according to the invention is provided.

It may be provided that a cooling unit, a cooking chamber atmosphere circulation unit, a unit for introducing moisture into the cooking chamber, in particular in the form of a steam generator, a unit for exhausting moisture from the cooking chamber, a unit for atomizing water in the cooking chamber, a power storage unit, an operating unit, a data storage unit, and/or a cleaning unit, preferably each operationally linked to the control or regulating unit.

It may also be provided that the measuring unit comprises a zeroth measuring unit for detecting a temperature in the steam generator, a first measuring unit for detecting a temperature in the cooking chamber, and/or a third measuring unit for detecting a temperature of a wall of the cooking chamber.

Furthermore, it is proposed that the display unit comprise a display panel for a progress display.

It is also proposed by the invention that the progress display comprise at least two areas, one of these areas, in particular in the form of a bar, growing during a progress when reaching the desired climate.

It may be provided that the growing area appears in a first color, in particular in red, during heating, and/or the growing area appears in a second color, in particular in blue, during cooling.

Finally, a cooking appliance is also proposed according to the invention, which is characterized by a further measuring unit for the second variable.

The invention is based on the surprising finding that during the execution of a program in a cooking appliance to reach a specific desired climate in the cooking chamber of the cooking appliance, such as a specific desired cooking chamber temperature in a preheating step before charging of the cooking chamber with cooking product, which is to be cooked using a specific cooking method, a division into two time intervals is to occur for the display of the progress when reaching the desired climate. Specifically, because at the beginning of the execution of the program, the course of a first variable characteristic of the climate in the cooking chamber, such as the cooking chamber temperature, over time, is not yet known, said course also cannot be used for calculating the progress when reaching the desired climate, so that a rough estimation of said progress occurs in a first time interval, namely purely punctually from a time aspect. For example, a linear relationship between the first variable and the time may be assumed. In a second time interval, according to the invention, a more precise calculation of the progress is performed by at least a single evaluation of the course of the first variable over time, for example, using empirically ascertained values, which are stored in the cooking appliance, for the chronological course of the first variable.

It is especially advantageous according to the invention to take the starting and/or pre-usage state of the climate in the cooking chamber, i.e., at the beginning of the program, into consideration for the calculation of the progress. This starting state may be identified in consideration, for example, of the history of the operation of the cooking appliance (second variable) and/or with evaluation of the time course of the first variable, in particular in a heating pause. If the desired climate is, for example, predetermined by a desired cooking chamber temperature and the cooking chamber temperature is detected as the first variable, after passage of approximately 10 to 15 seconds, a heating unit may briefly be shut down in a heating step. If the cooking chamber was cold at the beginning of the heating step, the cooking chamber temperature will only overshoot to a slight extent and then decrease rapidly again. However, if the cooking chamber was already heated at the beginning of the preheating step, there is a significant overshoot, without a decrease following. Therefore, it may also be directly recognized from the course of the cooking chamber temperature in a heating pause, which preferably lies between the first time interval and the second time interval, what the cooking chamber temperature was at the beginning of a heating step. The corresponding information may be taken into consideration during the calculation of the heating progress, in particular in the form of a remaining heating time.

The determination of the progress when reaching a desired climate may be made more precise by evaluating a plurality of measured values of the first variable, for example, in the form of a request of the cooking chamber temperature and of the temperature of the wall of the cooking chamber every second. Climate parameters at the setup location of the cooking appliance and the geodetic height at the setup location, which also represents second variables in the meaning of this application, also influence the heating progress and may be taken into consideration in the calculation thereof.

If a malfunction of the cooking appliance occurs during the execution of the program, for example, by a power failure, the failure of an actuator or the like, or an opening of a door to the cooking chamber occurs, which is preferably detectable as a second variable, this is also to be taken into consideration according to the invention for the calculation of the progress display.

Information obtained for the calculation of the progress when reaching the desired climate may advantageously also be taken into consideration during a possibly following direction of a cooking process, for example, in the form of the calculation of a period of time, during which the desired cooking chamber temperature is to be maintained, before the cooking chamber is charged with cooking product and the like.

The evaluation of the transient oscillation to a desired cooking chamber temperature is also of interest for the direction of a cooking process, in particular with evaluation of the frequency of said transient oscillation.

The method according to the invention thus provides an array of advantages, according to which a user of the cooking appliance not only has the uncertainty removed as to whether a cooking appliance is actually preheating or cooling, for example, namely by the progress display according to the invention, but rather also obtains precise information about the time needed until the charging or loading of the cooking chamber. The user, after selection of a specific use, for example, a specific cooking method, does not have to deal with the values for the temperature and/or moisture for reaching a desired climate before charging the cooking chamber, but rather may simply observe the progress when reaching the desired climate on a graphic display, on which a color change from red to blue to display heating is shown like a progress bar, for example.

Further features and advantages of the invention result from the following description, in which embodiments according to the invention are explained for exemplary purposes. In the figures.

Figure 1:
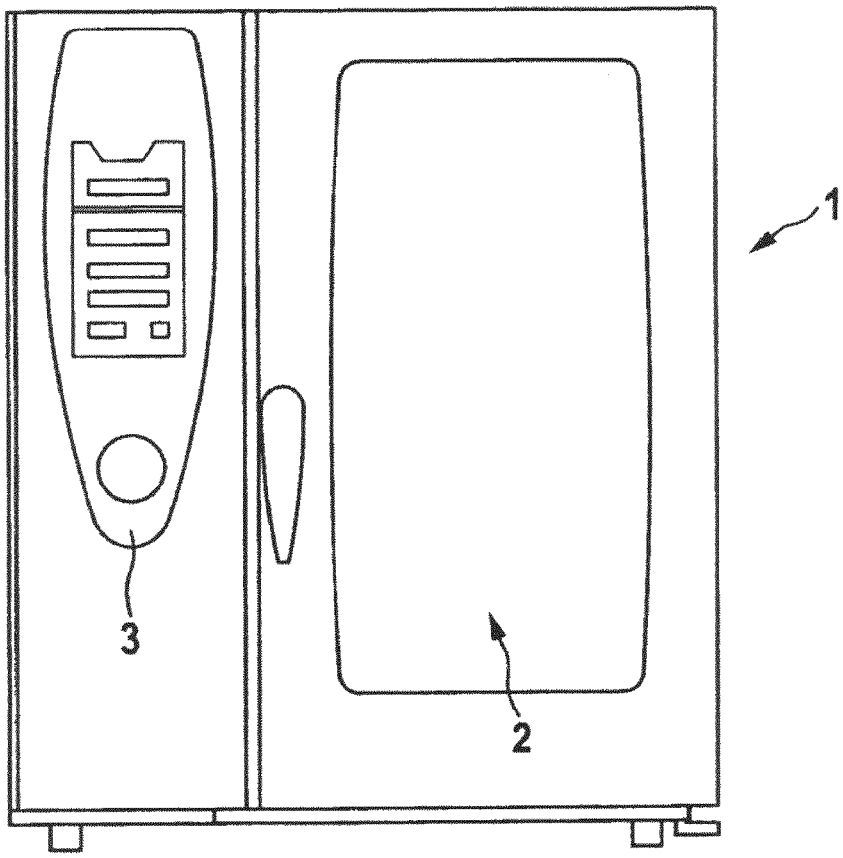
FIG. 1 shows a cooking appliance according to the invention.

As may be inferred from FIG. 1, a cooking appliance 1 according to the invention comprises a cooking chamber 2 and a display and operating unit 3, in addition to a heating unit (not shown), for warming up the atmosphere in the cooking chamber, a first measuring unit (not shown) for detecting the cooking chamber temperature, a clock (not shown), a data memory (not shown), and a regulating unit (not shown), which is connected to the display and operating unit 3, the heating unit, the measuring unit, the clock, and the data memory. The heating unit may be implemented in greatly varying ways, for example, in the form of an electrical heater, a heat exchanger, a microwave source, or the like. In addition to the heating unit, at least one unit (not shown) for introducing moisture into the cooking chamber 2 and one unit (not shown) for exhausting moisture from the cooking chamber 2 may also be provided.

Figure 2:
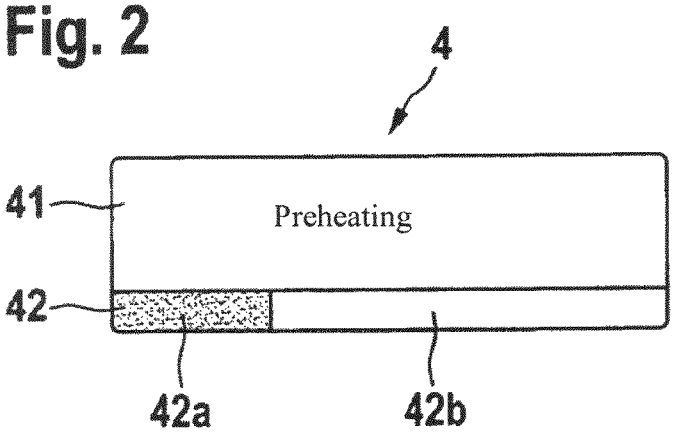
FIG. 2 shows a display panel of the cooking appliance shown in FIG. 1.

A partial area of the display and operating unit 3 from FIG. 1 in the form of a display panel 4 is shown in FIG. 2, which is automatically visible during a preheating step on the display and operating unit 3. More precisely, a user of the cooking appliance 1 must seek out a cooking method and/or cooking program via the display and operating unit 3, after whose initiation from a moment $t_0$ a heating step first automatically occurs, with a specific desired cooking chamber temperature $GT_{Des}$, and display of a heating progress in the display panel 4. In the display panel 4, it may be read in a text panel 41 that it is preheating, while it may be read in a progress display panel 42 what precisely the heating progress is. Thus, the left area 42*a* in FIG. 2 represents a time which has already passed, for example, while the corresponding right area 42*b* represents a remaining heating time, like a progress bar.

Alternatively, it is also conceivable that the progress display panel 42 is divided into three areas, and the calculation of the preheating progress occurs in different ways in each of the three areas. An estimation of the moment $t_3$, at which the determined desired cooking chamber temperature exists, occurs in each of the three areas, so that the preheating progress results from the difference of $t_3$ and the actual time t which is passed.

For example, in a zeroth time interval up to the moment $t_0$, the estimation of $t_3$ may be performed as a function of the temperature of the water in a steam generator (not shown), the zeroth moment $t_0$ being determined as the moment at which the water temperature is 85° C., for example. From $t_0$, heating of the cooking chamber atmosphere occurs via the heating unit and a steam generator, i.e., by hot air and steam. In a first time interval, namely from $t_0$, $t_3$ is estimated via the temperature of the cooking chamber atmosphere. As soon as the temperature of the cooking chamber atmosphere has reached the desired cooking chamber temperature, which will be at a first moment $t_1$, in a third time interval, the estimation of $t_3$ occurs as a function of the rise of the temperature of the cooking chamber wall over time. The preheating step is only concluded, when the wall temperature has also reached the desired cooking chamber temperature, i.e., $t_3$ is reached. In the first time interval from $t_0$ to $t_1$, an estimation of a second moment $t_2$, which corresponds to $t_1$, and $t_3$ occurs as a function of a comparison of the actual value of the temperature of the cooking chamber atmosphere to the desired cooking chamber temperature, and in the second time interval from $t_1=t_2$ to $t_3$, the actual value of the cooking chamber wall temperature is used with the desired cooking chamber temperature to determine the third moment $t_3$.

The zeroth time interval allows an acceleration of the heating of the cooking chamber, because steam is also introduced into the cooking chamber during the preheating, and the preheating of the water in the steam generator thus provides a contribution to the length of the preheating step. The second interval is necessary because the walls of the cooking chamber warm up more slowly than the atmosphere which is circulated in the cooking chamber, which may be warmed up more easily via the heating unit and the steam by the circulation. However, the desired cooking chamber temperature exists in the entire cooking chamber and the preheating step is thus concluded only when the wall temperature has reached the desired cooking chamber temperature.

Figure 3:
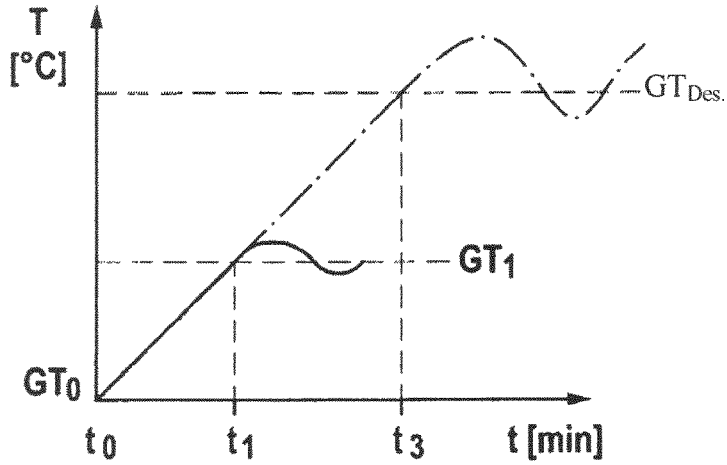
FIG. 3 shows the course of a cooking chamber temperature over time in a heating step.

The course of the cooking chamber temperature GT over the time t in a preheating step is shown in FIG. 3. More precisely, a first time interval from $t_0$ to $t_1$ is shown, in which the cooking chamber temperature GT grows essentially linearly with the time t. In this first time interval, the heating progress is approximated as linear until reaching the desired cooking chamber temperature $GT_{Des}$, on the basis of cooking chamber temperatures recorded every second, and measured value for measure value.

At the moment $t_1$, the heating unit is briefly turned off; a heating pause thus occurs. It may be recognized on the basis of the course of the cooking chamber temperature GT over the time t during this heating pause how high the cooking chamber temperature $GT_0$ was at the moment $t_0$, i.e., in the starting state of the cooking appliance 1 at the beginning of the heating step. The course of the cooking chamber temperature GT for three different starting states thereof may be inferred from FIGS. 4*a* through 4*c:*

Figure 4A:
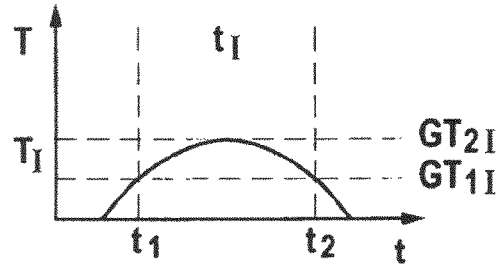
FIGS. 4*a* through 4*c* show the course of the cooking chamber temperature over time in a heating pause during a heating step according to FIG. 3.

The course of the cooking chamber temperature with an originally cold cooking chamber is shown in FIG. 4*a*. Accordingly, a rise of the cooking chamber temperature from $GT_{1I}$ to $GT_{2I}$ and subsequently a decrease back to $GT_{1I}$ occur in the heating pause up to the moment $t_2$. The difference $T_1=GT_{2I}-GT_{1I}$ is small.

Figure 4B:
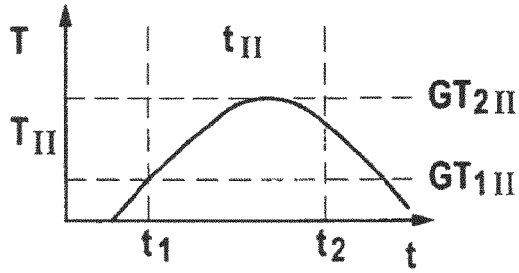

If the cooking chamber temperature is already elevated in the starting state, there is a higher difference $T_{II}=GT_{2II}-GT_{1II}$, as shown in FIG. 4*b*, in the same time window, i.e., in the time interval between $t_1$ and $t_2$.

Figure 4C:
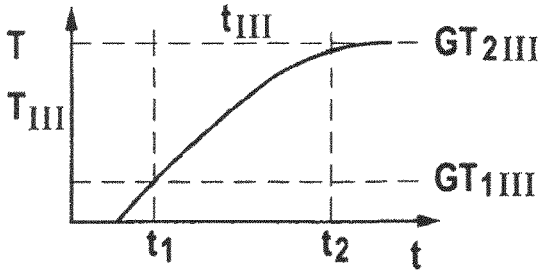

In contrast, if the starting state was such that a high cooking chamber temperature existed, the temperature difference $T_{1II}=GT_{2II}-GT_{1III}$ is also very high, as shown in FIG. 4*c*, and a decrease of the cooking chamber temperature does not occur in the cited time interval between $t_1$ and $t_2$.

In other words, by observing the cooking chamber temperature in a heating pause from $t_1$ to $t_2$, the cooking chamber temperature may be determined at the moment $t_0$, i.e., the starting state of the climate in the cooking chamber.

The starting cooking chamber temperature $GT_0$ thus determined is taken into consideration in a second time interval from $t_2$ to $t_3$ in the calculation of the heating progress, which makes the progress display according to FIG. 2 significantly more precise. Empirically ascertained chronological behavior of the cooking chamber temperature, which is stored in the data memory, is used for this purpose. This calculation of the heating progress preferably occurs every second.

A precise display of the heating progress is thus available to a user of the cooking appliance 1 during a complete preheating step, namely in the form of the length of the bar represented by the area 42*a*.

The information obtained during the preheating step, in particular about the starting state of the cooking chamber climate, may also be taken into consideration in the further execution of a selected cooking process. In addition, the transient oscillation behavior after reaching $GT_{Des}$, at the moment $t_3$, as indicated in FIG. 3 by the dot-dash line, may be taken into consideration, on the one hand in the determination of the moment at which the cooking chamber 2 is to be charged with the cooking product (not shown) to be cooked, and on the other hand in the following cooking process.

The features of the invention disclosed in the preceding description, the claims, and the drawings may be essential for implementing the invention in its various embodiments both individually and also in any arbitrary combination.

List of Reference Numerals

1 cooking appliance
2 cooking chamber
3 display and operating unit
4 display panel
41 text panel
42 progress display panel
42*a* area of the time which has passed
42*b* area of the remaining time

The invention claimed is:

1. A method for displaying the progress of a desired climate in a cooking chamber of a cooking appliance wherein, during the execution of a program in the cooking appliance to reach a determined desired climate in the cooking chamber of the cooking appliance, the progress at a plurality of moments t is displayed, the method comprising:

during a first time interval from $t_0$ to $t_1$, estimating a moment $t_3$ of the reaching of the desired climate and a moment $t_2$ at which a second time interval is to be started, wherein $t_1 \leqq t_2 < t_3$.

detecting a value of a first variable at least once, the first variable being characteristic of the climate in the cooking chamber and changing over time;

comparing the detected value of the first variable with a desired value of the first variable which characterizes the desired climate in the first time interval to estimate the moments $t_2$ and $t_3$; and during the second time interval from $t_2$, to $t_3$, estimating the moment $t_3$ by taking the course of the first variable over time into consideration at least once and by using stored tables on the chronological development of the first variable

2. The method according to claim 1, wherein upon the estimation of the moment $t_3$, a linear relationship between the first variable and the time is assumed.

3. The method according to claim 1, wherein the course of the first variable over time is determined via at least one time derivative.

4. The method according to claim 1, wherein the course of the first variable over time is evaluated in a heating pause from $t_1$ to $t_2$ with $t_2>t_1$.

5. The method according to claim 4, wherein the difference of the first variable at the moment $t_2$ and the first variable at the moment $t_1$ is evaluated.

6. The method according to claim 1, wherein the first variable is determined by at least one temperature, one moisture, or one flow rate.

7. The method according to claim 1, wherein a value of the first variable is detected in the cooking chamber, in the form of the cooking chamber temperature.

8. The method according to claim 7, wherein the cooking chamber temperature is detected, in a preheating or precooling step before charging the cooking chamber with cooking product to be cooked.

9. The method according to claim 7, wherein a value of a first first variable in the form of the cooking chamber temperature is detected in the first time interval, and a value of a second first variable in the form of the wall temperature is detected in the second time interval, and wherein $t_2=t_1$.

10. The method according to claim 1, wherein within a zeroth time interval with $t\leqq t_0$, the moment $t_3$ is estimated at least once as a function of a third first variable in the form of the temperature of the steam generator.

11. The method according to claim 9, wherein in a preheating step at the moment $t_0$, the temperature of the steam generator reaches a first desired value, in the range from 80° C. to 90° C., and at the moment $t_1$, the cooking chamber temperature reaches a second desired value, and at the moment $t_3$, the wall temperature reaches a third desired value.

12. The method according to claim 1, wherein at least one second variable characteristic of the climate in the cooking chamber is taken into consideration at least once during the estimation of the moment $t_3$.

13. The method according to claim 12, wherein the second variable is determined by the history of the operation of the cooking appliance, at least one setting of the cooking appliance at the moment $t_0$ or before the moment $t_0$.

14. The method according to claim 13, wherein the setting is selected from a group consisting of the setting of a heating unit, a cooling unit, a cooking chamber atmosphere circulation unit, a unit for introducing moisture into the cooking chamber, a unit for exhausting moisture from the cooking chamber, a unit for atomizing water in the cooking chamber, a power storage unit, an operating unit, and a unit for cleaning the cooking chamber.

15. The method according to claim 13, wherein the setting is determined by a first use of the cooking appliance, which occurred before the moment $t_0$.

16. The method according to claim 12, wherein the second variable is determined by the climate or the geodetic height at the setup location of the cooking appliance.

17. The method according to claim 12, wherein the second variable is determined by at least one of the duration, the frequency, the size of the cooking chamber opening, and a combination thereof.

18. The method according to claim 12, wherein the second variable is determined by a malfunction of the cooking appliance.

19. The method according to claim 1, wherein the desired climate is automatically selected after the selection of a second use of the cooking appliance and the initiation thereof at the moment $t_0$.

20. The method according to claim 19, wherein the first and second use are selected from a group consisting of a cooking method, a cleaning method, and a decalcification method.

21. The method according to claim 1, wherein a heating progress is displayed or a cooling progress is displayed.

22. The method according to claim 1, wherein the display of the progress is updated at regular time steps.

23. The method according to claim 1, wherein, at a plurality of moments t, the difference between the particular estimated moment $t_3$ and the particular time which has passed since the beginning of the method is displayed on a display unit.

24. The method according to claim 23, wherein the display unit has a display area for each time interval, and wherein the progress preferably being shown in each display area in the form of a growing bar.

25. The method according to claim 24, wherein three display areas are situated adjacent to one another, and wherein firstly a zeroth display area being provided for the zeroth time interval, then a first display area for the first time interval, and finally a third display area for the third time interval.

26. The method according to claim 1, further comprising: at a moment $t_4$ with $t_3\leqq t_4$, outputting a signal in the form of a charging request in the case of a use in the form of a cooking method.

27. The method according to claim 26, wherein the progress is taken into consideration in a second use of the cooking appliance, at least from a moment $t_5$, with $t_5\geqq t_3$.

28. The method according to claim 27, wherein, in a third time interval from $t_3$ to $t_4$, with $t_4\geqq t_3$, the course of the first variable over time is detected and is taken into consideration during the direction of a cooking method from the moment $t_5$, with $t_5\geqq t_4$.

29. The method according to claim 27, wherein the moment $t_5$ is determined from the progress.

30. The method according to claim 28, wherein, in the third time interval, a transient oscillation of the first variable to its desired value is evaluated.

31. A cooking appliance comprising a cooking chamber, a heating unit, a timer, at least one measuring unit for detecting a value of a first variable, a display unit for displaying the progress of a desired climate in a cooking chamber of the cooking appliance and a control or regulating unit to configured to estimate a moment $t_3$ of the reach of the desired climate and a moment $t_2$ at which a second time interval is to be started, wherein $t_1\leqq t_2<t_3$ and, wherein the detected value of the first variable is compared with the desired value to estimate the moment $t_3$ and $t_2$ during the first time interval and during the second time interval from $t_2$ to $t_3$, the moment $t_3$ is estimated by taking the course of the first variable over time into consideration and by using stored tables on chronological development of the first variable.

32. The cooking appliance according to claim 31, further comprising: a cooling unit, a cooking chamber atmosphere circulation unit, a unit for introducing moisture into the cooking chamber, a unit for exhausting moisture out of the cooking chamber, a unit for atomizing water in the cooking chamber, an operating unit, a data storage unit, and a cleaning unit.

33. The cooking appliance according to claim 31, wherein the measuring unit comprises a zeroth measuring unit for detecting a temperature in the steam generator, a first measuring unit for detecting a temperature in the cooking chamber, and a third measuring unit for detecting a temperature of a wall of the cooking chamber.

34. The cooking appliance according to claim 31, wherein the display unit comprises a display panel for a progress display.

35. The cooking appliance according to claim 34, wherein the progress display comprises at least two areas, one of these areas growing during a progress when reaching the desired climate.

36. The cooking appliance according to claim 35, wherein the growing area appears in a first color during heating, and the growing area appears in a second color during cooling.

37. The cooking appliance according to claim 31, further comprising a further measuring unit for the second variable.

38. The method according to claim 1, wherein a value of the first variable is detected on a wall of the cooking chamber in the form of the wall temperature.

39. The method according to claim 1, wherein a value of the first variable is detected in a steam generator of the cooking appliance in the form of the water temperature in the steam generator.

40. The method according to claim 12, wherein the second variable does not change from $t_0$ to $t_3$, at least in normal operation of the cooking appliance.

41. The method according to claim 13, wherein the second variable is determined by the history of the operation of the cooking appliance in the form of the operating time.

42. The method according to claim 28, wherein, in the third time interval, the transient oscillation of the first variable to its desired value is evaluated by detecting the frequency and the amplitude of the corresponding oscillation.

* * * * *